United States Patent [19]

Withorn

[11] 3,948,617

[45] Apr. 6, 1976

[54] METHOD OF REDUCING SULPHUR DIOXIDE EMISSIONS FROM COMBUSTIBLE MATERIALS

[76] Inventor: Benjamin Withorn, 601 Forbes St., Falmouth, Va. 22401

[22] Filed: Feb. 19, 1974

[21] Appl. No.: 443,403

Related U.S. Application Data

[63] Continuation-in-part of Ser. No. 296,674, Oct. 11, 1972, abandoned.

[52] U.S. Cl. ..... 44/4; 44/50; 44/51; 75/42; 201/17

[51] Int. Cl.[2].. C10L 9/00; C21B 5/00; C10B 57/00; C10L 1/00

[58] Field of Search ..... 44/4, 5, 51, 50, DIG. 3; 423/225, 234; 201/17; 75/42

[56] References Cited

UNITED STATES PATENTS

| | | | |
|---|---|---|---|
| 2,019,468 | 10/1935 | Bacon | 423/225 |
| 3,004,836 | 10/1961 | Thompson | 44/4 |
| 3,179,513 | 4/1965 | Toulmin, Jr. | 75/42 |

FOREIGN PATENTS OR APPLICATIONS

| | | | |
|---|---|---|---|
| 23,951 | 10/1908 | United Kingdom | 44/4 |

*Primary Examiner*—Carl F. Dees
*Attorney, Agent, or Firm*—Frank P. Cyr

[57] ABSTRACT

The reduction of emission of sulphur dioxide from fuels containing sulphur components when such fuels are combusted. The reduction of such sulphur dioxide emissions upon the combustion of such sulphur containing fuels is accomplished by the introduction into such fuels an alkali additive which is pressure fed into such fuels at a point closely adjacent the burner structure for the combustion process thus insuring for the intimate mixture of such alkali material with the fuels to be combusted. The alkali material serves to neutralize the sulphur containing impurities which are normally caused to exit through a conventional stack exit for the exhaust gases from the burner.

6 Claims, 1 Drawing Figure

METHOD OF REDUCING SULPHUR DIOXIDE EMISSIONS FROM COMBUSTIBLE MATERIALS

This is a Continuation-in-Part of patent application Ser. No. 296,674, filed Oct. 11, 1972 now abandoned.

BACKGROUND OF THE INVENTION

Kerosenes and gasolines are usually refined so that the total sulphur content remaining in the product delivered to the ultimate consumer is reduced usually to a 0.2% by weight. A further reduction of the sulphur content in such fuels is not warranted by reason of the costs involved in a further reduction of the sulphur content.

Referring now to the coal producing industry, it can be stated that they are not process-research oriented and its air-pollution research and development has, at best, been fragmented. Low sulphur content coal is in very limited quantity and a number of municipalities have enacted ordinances banning the burning of coal for any purpose where such coal has a higher sulphur content than that set forth in the aforesaid ordinances. Thus, there is presented a situation which necessitates a choice on only burning a coal with a sulphur content therein within the limits set forth in ordinance guidelines or provide for the employment of a coal having a higher sulphur content than that ordinance authorized and make provision to reduce the sulphur dioxide emitted into the atmosphere upon the combusting of such high sulphur content coal. The same theory applies to liquid and/or gaseous fuels which have an undesirable amount of sulphur therein and when combusted, an undesirable amount of sulphur dioxide is exhausted into the surrounding atmosphere.

With the above in mind, it is the primary object of the invention to provide a simple and economical means for effecting a reduction of emission of sulphur dioxide into the surrounding atmosphere when a high sulphur content fuel is combusted.

Another object of the invention is to feed under pressure an alkali into a combustible substance, immediately prior to the feeding of such combustible into the burner structure so as to insure a mixture of such alkali with said combustible substance prior to combustion thereof, to obviate the release of carbon dioxide into the surrounding atmosphere when said combustible material is combusted.

Another object of the invention is to provide a means whereby an alkali in either liquid or powder form is pressure forced into a solid charge of combustible material, such as coal and/or coke, wherein such alkali material will, upon combustion of the combustible material, neutralize the sulphur dioxide formed during the combustion of the said combustible material.

Another object of the invention is to improve the qualities of a fuel employed in an internal combustion engine. The sulphur dioxide formed by the combustion of a sulphur containing fuel results in corrosion of the parts of the engine and parts associated therewith, and here again, the object of the invention is to reduce the amount of such corrosion by treating such fuel, prior to combustion of such fuel, to an alkali which will neutralize the usually formed sulphur dioxide.

A still further object of the invention is to provide for an easy manner in which the structure of the present invention may be conveniently adapted to existing structures, using either a liquid or a solid fuel for combustion.

Other objects will be apparent from the following description and claims, which, by way of illustration, show a preferred embodiment of the invention, and the principles thereof, and which is now considered to be the most advantageous mode in which to apply such principles. Other embodiments embodying the same or equivalent principles may be applied by those skilled in the art without departing from the scope of the present invention.

DESCRIPTION OF THE DRAWINGS

The single FIGURE of the drawing illustrates diagramatically an installation whereby the objects of the invention may be achieved.

DESCRIPTION OF THE PREFERRED EMBODIMENTS

Figure 1:
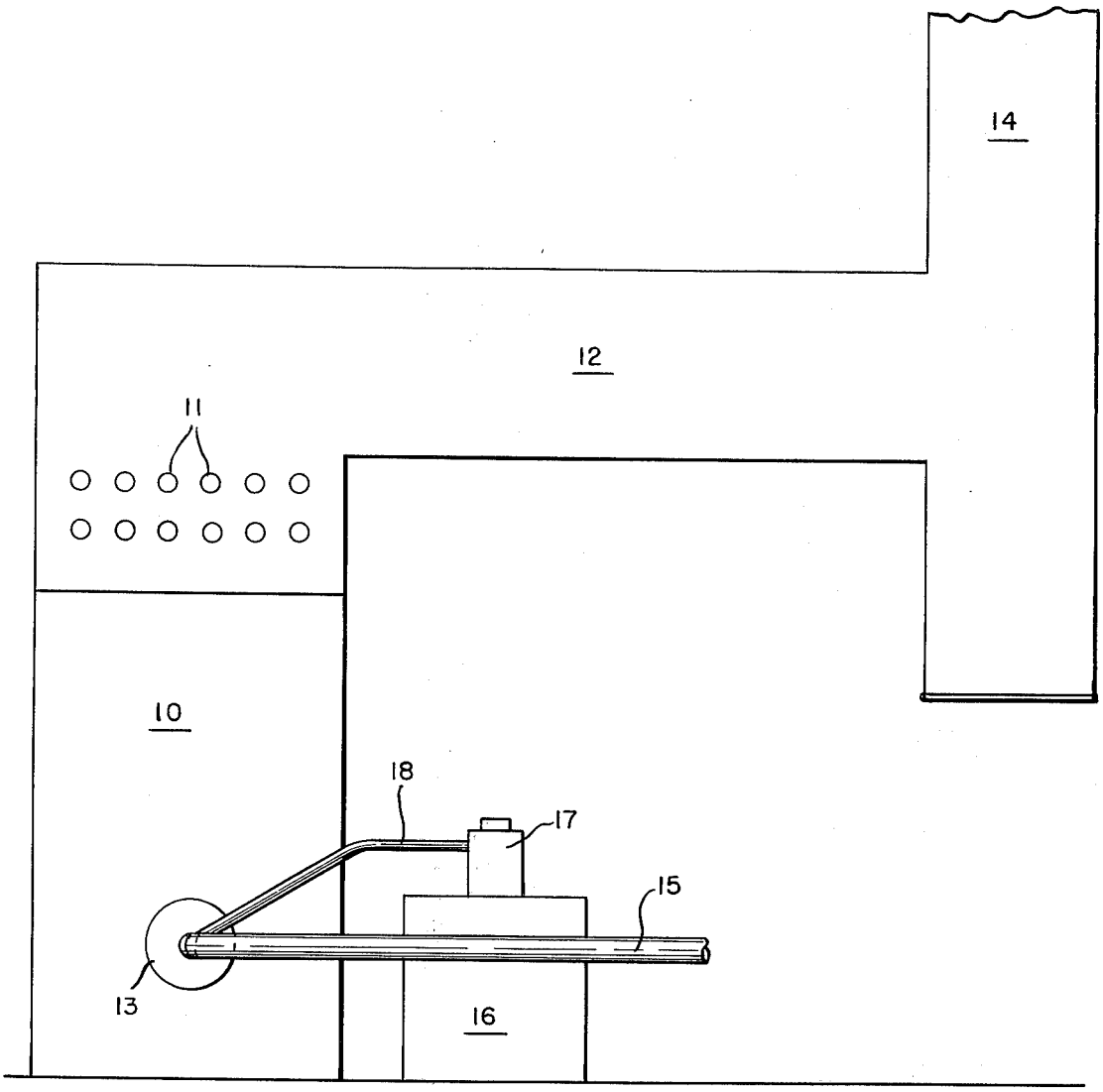

Referring now to FIG. 1 of the drawing, there is shown therein, in diagramatic form only, a furnace or boiler 10 of usual construction having a series of heat exchange pipes 11 arranged in the upper portion of the combustion area defined within the furnace 10. An exit 12 for the flue gases emenating from a burner structure 13 leads to a stack 14, all being constructed in a known and convenient manner.

The burner 13 as shown in the drawing may be of any known type either adapted to burn a liquid or a solid combustible mixture. A fuel feed line 15 extends to the burner 13 and the same may receive its source of fuel material from any convenient source of supply. In the event the fuel supplied to the burner 13 is a liquid the same may be supplied thereto by any known means such as a pumping apparatus. In the case of a solid fuel, such as pulverized coal or coke, the same can be fed to the burner structure by any known means such as a blower or like apparatus.

Positioned adjacent to the furnace structure 10, or for that matter, remotely positioned therefrom is an alkali containing container 16 which is provided with a suitable pump structure 17 for withdrawing material from within the container 16 and direct the same under pressure through a conduit 18 to a position adjacent the burner 13. Suitable dispersing nozzles may be provided although other suitable apparatus may be used to accomplish the same purpose.

That is, the dispensing nozzles will insure the proper mixing of the alkali with the fuel being fed into the burner and the mixing of the components will take place at a point immediately prior to the introduction of the mixture into the burner structure.

The conduit 15 is designed to feed either a liquid, gas or a dust type combustible material such as coal dust or the like to the burner structure 13. In the event the combustible mixture is an oil or other type fluid of a flammable nature, the same is fed to the conduit 15 by means of a suitable pump (not shown). In cases where a pulverized fuel, such as coal dust, or the like, is employed as the combustible mixture, a suitable pump (not shown) is employed to deliver such fuel to the burner 13.

The pump 17 is of the aspirator type and, when activated by means of any suitable motor (not shown), it will deliver in metered amounts to the feed line 18, an alkali determined suitable in amount to neutralize the sulphur content in the fuel supplied to the bruner structure 13, when the fuel is combusted.

The invention thus far has been described as employed in the reduction of the emission of sulphur dioxide gases from a combustion area such as a furnace or the like. However, it should be pointed out that the same may be applied to the neutralizing of the carbon dioxide gases emitting from the combustion gases of an internal combustion engine. In such an installation, the pump 17 and alkali container 16 may be positioned in close proximity to the intake manifold of a carburetor of an automobile engine and to supply thereinto under pressure a metered amount of an alkali so as to co-mingle with the incoming fuel and upon combustion thereof, the alkali serving to neutralize the sulphur content of the fuel with ensuing emission of a cleaner air from the exhaust of an automobile exhaust system.

As can be appreciated, the amount of alkali fed to the combustible charge may be effectively regulated so as to obviate as much as possible the emission of any carbon dioxide from combustible mixture, thus assisting in the rid of air pollutants.

The alkali solution referred to above may be in either liquid or powder form and the amount thereof fed into the upstream side of the combustion camber can be regulated by means of a suitable metering device associated with the pump 17 and such metering devices are well known in the pump art.

Sulphur neutralizing alkali as used in the specification and claims means any material which can neutralize acidic sulphur components present in petroleum or produced during oxidation thereof, including but not limited to, sulphur dioxide, hydrogen sulphide, and mercaptans. The term alkali includes the hydroxides of the various metals all of which give hydroxide ions in aqueous solution, namely, the monovalent bases, for example, potassium hydroxide, sodium hydroxide, lithium hydroxide; the divalent bases, for example, calcium hydroxide and magnesium hydroxide; and the trivalent bases, such as aluminum hydroxide.

Generally, the relatively soluble bases of the Group I metals, that is, sodium hydroxide, potassium hydroxide and lithium hydroxide, are preferred in the practice of this invention because of the ease of handling concentrated solutions thereof rather than using solvents. Thus, lithium hydroxide has a solubility of 12.7 grams per 100 milliliters of water whereas sodium hydroxide is soluble up to about 40 grams per 100 milliliters of water and potassium hydroxide is even more soluble. However, for reasons of economy and availability, sodium hydroxide is preferred as the alkali for use in the practice of this invention. Thus, use of solutions containing from about 20 grams to about 40 grams of sodium hydroxide per 100 milliliters of water is especially recommended.

The alkaline material may be either in liquid or powder or granular form and is fed under pressure to the combustible mixture on the upstream side of the feed of the fuel mixture in order to insure a good mixture of the alkaline substance with the combustible substance so that when the combustible material is combusted, the reaction between the alkaline material and the sulphur in the fuel takes place with a resultant lack of emission of sulphur dioxide into the atmosphere.

The invention is predicated on the fact that the addition of an alkaline to the combusting fuels, either liquid or solid, which have a sulphur content therein, will neutralize the sulphur dioxide formed during the combustion process, thus leading to a cleaner air environment as in the case of a furnace operation and in the case of an internal combustion engine, a cleaner exhaust atmosphere is obtained by reason of elimination of the sulphur dioxide from therein.

Obviously, other improvements and modifications of the invention as herein set forth may be made without departing from the spirit and scope thereof, and therefore, only such limitations should be imposed as are indicated in the appended claims.

What is claimed is:

1. The method of treating a sulphur containing combustible fuel which is fed under pressure to a burner structure through a suitable feed line, comprising, introducing under pressure into said feed line adjacent to and immediately prior to the introduction of said fuel to said burner structure, a sulphur neutralizing alkali, said alkali and said combustible fuel being pre-mixed in said feed line leading to said burner, said alkali fed in metered amounts into the said fuel feed line immediately prior to the feed of said combined charge of alkali and fuel to said burner structure to thereby neutralize the sulphur dioxide formed during the combustion of the said fuel and admixed alkali to thus effect a release into the atmosphere a gas substantially free of sulphur dioxide.

2. The recital of claim 1 wherein said alkali substance is a liquid.

3. The recital of claim 1 wherein said alkali is a powder.

4. The recital of claim 1 wherein said combustible fuel is a liquid fuel.

5. The recital of claim 1 wherein said combustible fuel is a powdered fuel.

6. The recital of claim 1 wherein said combustible fuel is a solid fuel.

* * * * *